US010415910B1

(12) United States Patent
Zukowski

(10) Patent No.: US 10,415,910 B1
(45) Date of Patent: Sep. 17, 2019

(54) OFFSET FEED MAGAZINE

(71) Applicant: Smith & Wesson Corp., Springfield, MA (US)

(72) Inventor: Gary Zukowski, Ludlow, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/366,042

(22) Filed: Mar. 27, 2019

Related U.S. Application Data

(60) Provisional application No. 62/675,191, filed on May 23, 2018.

(51) Int. Cl.
*F41A 9/61* (2006.01)
*F41A 9/69* (2006.01)
*F41A 9/70* (2006.01)

(52) U.S. Cl.
CPC . *F41A 9/69* (2013.01); *F41A 9/70* (2013.01)

(58) Field of Classification Search
CPC ..... F41A 9/65; F41A 9/69; F41A 9/70
See application file for complete search history.

(56) References Cited

U.S. PATENT DOCUMENTS 3,373,521 A * 3/1968 Into ..... F41A 9/65 42/50
3,399,480 A * 9/1968 Rowe, Jr. ..... F41A 9/69 42/50
4,580,364 A * 4/1986 Vyprachticky ..... F41A 9/65 42/50
4,672,760 A 6/1987 Chesnut et al.
4,790,094 A 12/1988 Chesnut et al.
4,862,620 A 9/1989 Chesnut et al.
5,113,604 A * 5/1992 Vyprachticky ..... F41A 9/66 42/50
6,397,721 B1 6/2002 Murello
7,398,615 B2 7/2008 Wheatley
7,877,918 B2 2/2011 Garavaglia
8,220,377 B2 7/2012 Quetschke et al.
8,448,558 B2 5/2013 Lasichak et al.
8,733,224 B2 5/2014 Lasichak et al.
8,863,422 B2 10/2014 Ballard
9,103,614 B2 * 8/2015 Froehle ..... F41A 9/67
2018/0023912 A1 1/2018 Cudazzo

FOREIGN PATENT DOCUMENTS

DE 3535014 A1 * 4/1986 ..... F41A 9/70
WO WO-9835199 A2 * 8/1998 ..... F41A 9/12

OTHER PUBLICATIONS

Author Unknown; DPMS Magazine for .30 Remington AR 4 Round—MA-R30-4; https://www.healyarms.com/dpms-magazine-for-30-remington-ar-4-round-ma-r30-4.

* cited by examiner

*Primary Examiner* — Gabriel J. Klein
(74) *Attorney, Agent, or Firm* — Ballard Spahr LLP; John A. Chionchio, Esq.

(57) ABSTRACT

An ammunition magazine for semiautomatic firearms has an opening at the end of a tube which is offset from the geometric center of the tube cross section and which is skewed about an axis extending lengthwise along the tube and through the geometrical center. Offset and skew of the opening are achieved by asymmetrically positioning the feed lips defining the opening relatively to the axis as well as angularly orienting the lips relatively to the bore of the tube.

17 Claims, 4 Drawing Sheets

OFFSET FEED MAGAZINE

CROSS REFERENCE TO RELATED APPLICATIONS

This application is based upon and claims benefit of priority to U.S. Provisional Application No. 62/675,191, filed May 23, 2018 and hereby incorporated by reference herein.

FIELD OF THE INVENTION

This invention relates to ammunition magazines for automatic and semiautomatic firearms.

BACKGROUND

Traditional ammunition magazines for automatic and semiautomatic firearms, in particular, "single-stack" pistol magazines, comprise a tube with a set of feed lips flanking the opening of the tube. These feed lips retain and control the position of the first cartridge in the magazine and guide it into the barrel chamber during feeding. Typically, the feed lips are symmetric about the center of the magazine tube, and the cartridges feed from the magazine on center. One of the drawbacks of a single stack magazine tube is the direct vertical stacking of cartridges, which can position the rim of the first cartridge directly over the rebate of the second cartridge immediately below it. This can result in "rim lock", where the rim of the first cartridge engages the rebate of the second cartridge, which can hinder cartridge feeding and even result in a malfunction. There is clearly an opportunity to improve the reliability of semiautomatic and automatic firearms by mitigating the effects of rim lock.

SUMMARY

The invention concerns an ammunition magazine for a firearm. In one example embodiment the magazine comprises a tube defining a bore adapted to receive a plurality of cartridges. The bore has an axis extending lengthwise along the tube through a geometric center of the bore. A base is positioned at a first end of the tube. The base is oriented transversely to the axis and underlies the bore. A follower is positioned within the bore and is movable through the tube lengthwise along the axis. A spring is positioned within the bore between the base and the follower for biasing the follower toward a second end of the tube opposite to the first end. A first lip is positioned on a first side of the tube at the second end of the tube. A second lip is positioned at the second end of the tube on a second side thereof opposite to the first lip. The second lip is closer to the axis than the first lip. The first and second lips thereby define an opening in the tube offset from the axis toward the first side of the tube.

In an example embodiment the bore has a rectangular cross sectional shape. Further by way of example, the second lip comprises an edge of a sidewall forming the tube. In another example, a portion of the sidewall comprising the edge is angularly oriented toward the axis. In a particular example the first and second lips are oriented angularly about the axis relatively to the bore. The opening defined by the lips is thereby skewed about the axis. In a practical example the opening is skewed at an angle to the axis ranging from 1° to 5°. In a specific example embodiment, the opening is skewed at an angle of 3° to the axis.

In an example embodiment the tube may comprise first and second sidewalls positioned respectively on first and second sides of the bore. A projection extends from one of the first and second sidewalls toward the bore. The projection is positioned in spaced relation to the opening and engageable with the cartridges for skewing the cartridges relatively to the axis. In an example embodiment the projection extends from the first sidewall. By way of example, the projection may be positioned to engage the cartridges adjacent to or within a rebate thereof. In a further example the projection may be positioned to engage the cartridges adjacent to a projectile thereof. In an example embodiment the projection comprises an elongated surface oriented parallel to the axis. Specifically by way of example, the elongated surface may further comprise a first ramp sloped toward the base. Additionally by way of example, the elongated surface may further comprise a second ramp sloped toward the opening.

In an example embodiment the tube comprises first and second sidewalls positioned respectively on first and second sides of the bore. The first and second sidewalls are in spaced apart relation sufficient to receive the cartridges in a single stack. In another example embodiment the tube comprises first and second sidewalls positioned respectively on first and second sides of the bore. The first and second sidewalls are in spaced apart relation sufficient to receive the cartridges in a semi-staggered stack.

DETAILED DESCRIPTION

Figure 1:
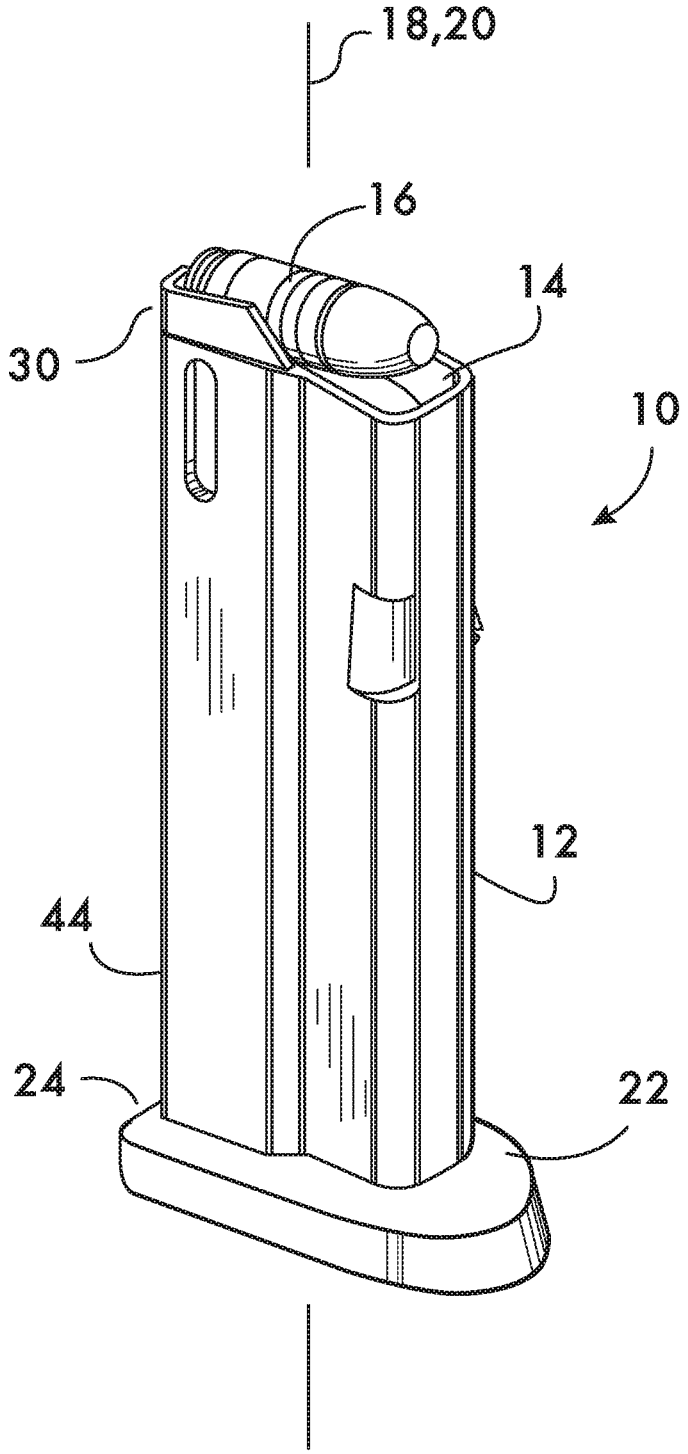
FIG. 1 is an isometric view of an example embodiment of an ammunition magazine according to the invention.
Figure 2:
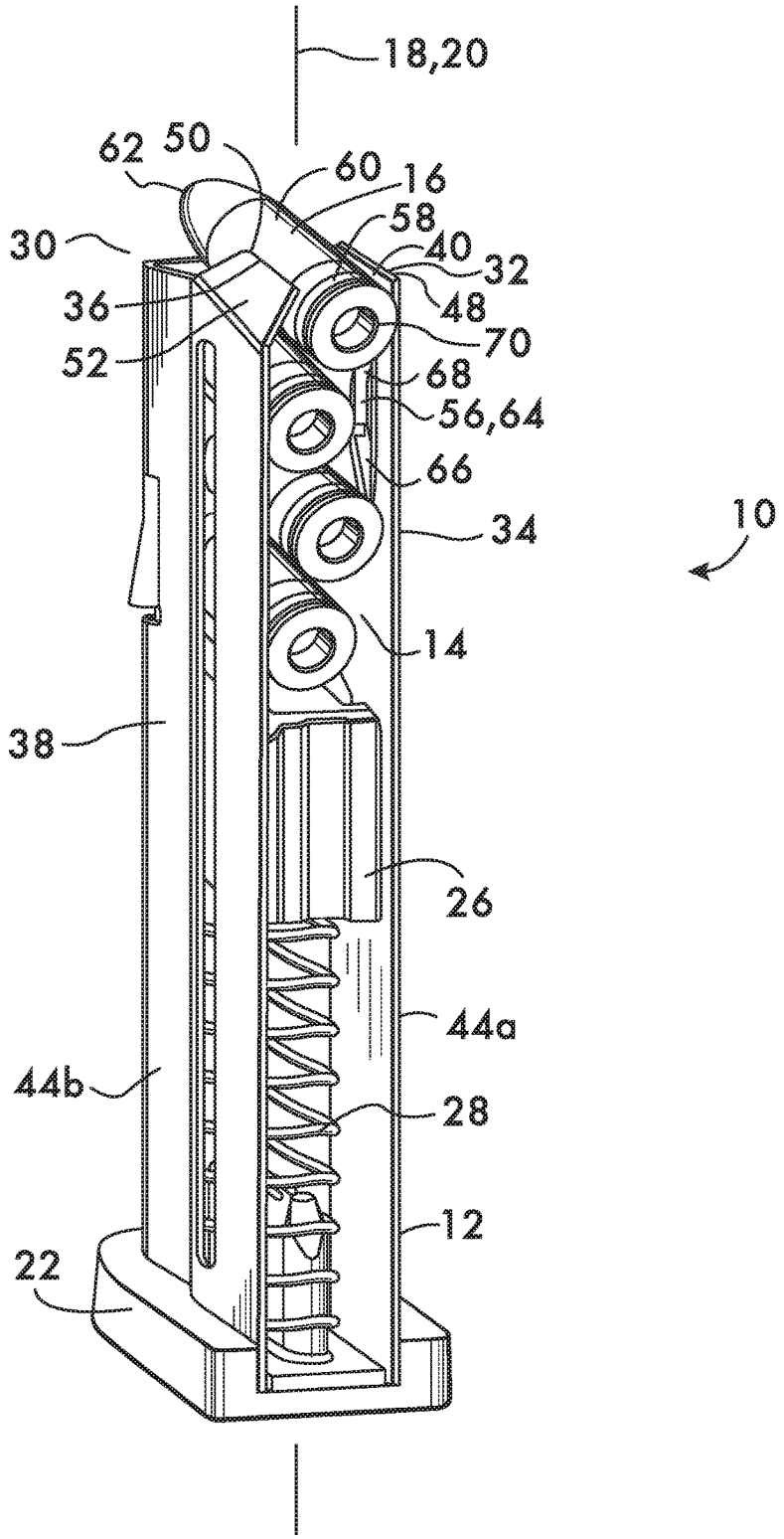
FIG. 2 is a partial cut-away isometric view of the magazine shown in FIG. 1.

FIG. 1 shows an example magazine 10 according to the invention. Magazine 10 comprises a tube 12 which defines a bore 14 adapted to receive a plurality of cartridges 16. An axis 18 extends lengthwise along tube 12 through a geometric center 20 of the bore. A base 22 is positioned at a first end 24 of the tube 12. Base 22 is oriented transversely to axis 18 and underlies the bore 14. As shown in FIG. 2 a follower 26 is positioned within bore 14. Follower 26 is movable lengthwise through tube 12 along axis 18 and thereby supports and feeds cartridges 16 to a firearm (not shown). A spring 28 is positioned within bore 14 between the base 22 and the follower 26. The spring 28 biases the follower 26 toward a second end 30 of the tube 12.

Figure 3:
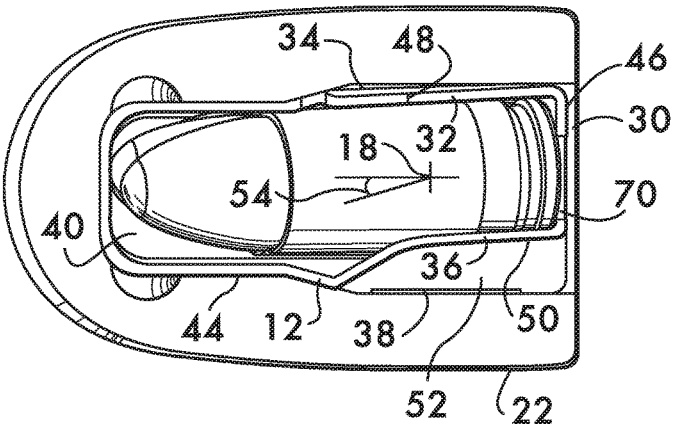
FIG. 3 is a top view of the magazine shown in FIG. 1.
Figure 4:
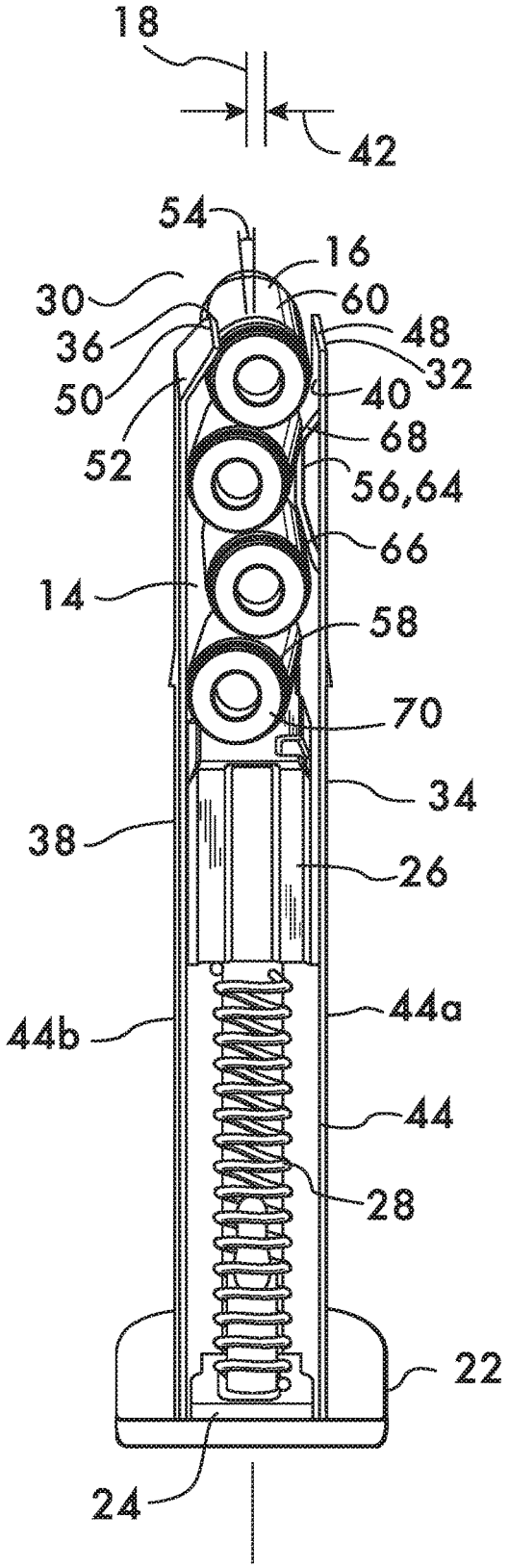
FIG. 4 is a partial cut-away rear view of the magazine shown in FIG. 1.

As shown in FIGS. 2 and 3, a first lip 32 is positioned on a first side 34 of the tube 12 at its second end 30. A second lip 36 is also positioned at the second end 30 of tube 12, the second lip 36 being positioned on a second side 38 of the tube opposite to the first side 34. The second lip 36 is closer to axis 18 than the first lip 32, and the lips 36 and 32 thereby define an opening 40 in tube 12 that is offset from axis 18, in this example, toward the first side 34. An offset distance 42 from axis 18 is depicted in FIG. 4 and the magnitude and direction of this offset distance will depend upon the firearm and the caliber of the ammunition. The lips 32 and 36 engage the "first" cartridge 16 in the magazine 10 and retain it against the biasing force of the spring 28 applied through follower 26.

As shown in FIG. 1 tube 14 is formed of interconnected sidewalls 44 which define bore 14 as having a generally rectangular cross sectional shape 46 sized and proportioned to accommodate cartridges 16 as shown in FIG. 3. As shown in FIGS. 2 and 4, the first lip 32 comprises an edge 48 of a first sidewall 44*a* and the second lip 36 comprises an edge 50 of the second sidewall 44*b*. In this example embodiment, a portion 52 of the second sidewall 44*b* comprising the edge 50 defining the second lip 36 is angularly oriented toward axis 18, thereby defining the offset of opening 40 from axis 18. As further shown in FIG. 3, the first lip 32 (edge 48) and second lip 36 (edge 50) are angularly oriented about axis 18 relatively to bore 14. This angular orientation of the lips 32 and 36 results in the opening 40 being skewed about axis 18. FIG. 3 shows a skew angle 54 of opening 40. Practical skew angles from about 1° to about 5° are feasible, with 3° considered advantageous.

As shown in FIGS. 2 and 4, a projection 56 extends from one of the sidewalls, in this example the first sidewall 44*a*, toward the bore 14. Projection 56 is positioned in spaced relation away from the opening 40 and is intended to engage the "second" cartridge 16 from the opening. Projection 56 is further positioned to engage the cartridges 16 adjacent to or within a rebate 58 of the cartridge casing 60. In another embodiment the projection could be positioned on the second sidewall and engage the cartridge adjacent to the projectile, bullet 62. Projection 56 skews the cartridges 16 about axis 18. In this example embodiment the projection comprises an elongated surface 64 oriented parallel to axis 18. To facilitate cartridge feeding the surface 64 comprises a first ramp surface 66 which slopes toward base 22 and a second ramp surface 68 which slopes toward the opening 40.

The offset of opening 40 is expected to mitigate "rim lock", a phenomenon which occurs when the rim 70 of the first cartridge 16 engages the rebate 58 of the second cartridge as the first cartridge is stripped from the magazine 10 during chambering of the cartridge. The skew angle 54 is intended to compensate for the offset of opening 40 and better align the bullet 62 of the first cartridge 16 with a feed ramp of a firearm. The skew angle is expected to increase the reliability of chambering the first cartridge during the firing cycle of the firearm. The projection 56 is intended to further control the location of rim 70 of the second cartridge and prevent contact between the rims of the first and second cartridges.

Figure 5:
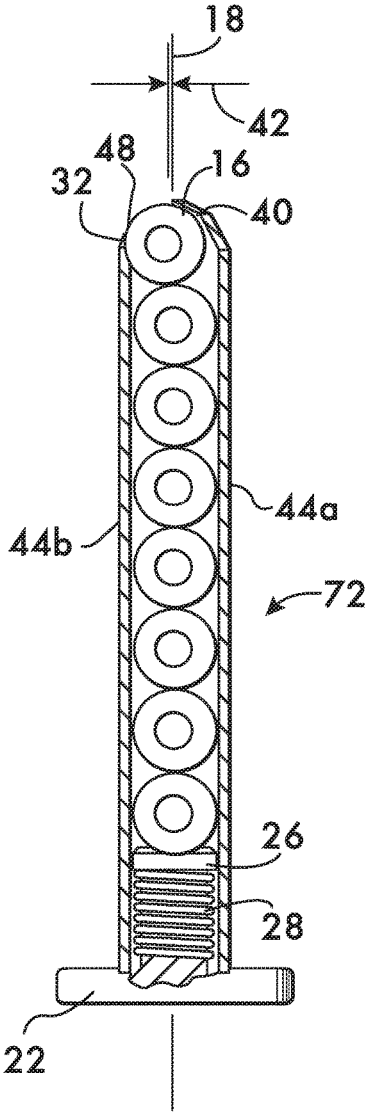
FIG. 5 is a rear sectional view of an example embodiment of a single stack magazine according to the invention.

The example magazine 10 shown in FIGS. 1-4 is a "semi-staggered" type magazine wherein the sidewalls 44*a* and 44*b* are separated by a distance which is greater than necessary to hold the cartridges 16 but less than that for a double stack magazine. It is expected that the features of the invention shown herein for a semi-staggered magazine will also be effective for a single stack magazine 72 as shown in FIG. 5. It is understood that the spaced apart relation of the sidewalls for each magazine type will be sufficient to receive the cartridges in the desired stack configuration and will be determined by the caliber of the ammunition.

Magazines according to the invention are expected to have the following advantages: 1) reduced slide spring force making it easier to "rack" the slide or bolt and chamber a round or clear a jam; 2) reduced magazine spring force making it easier to load cartridges into the magazine; and 3) reduced potential for feeding malfunctions leading to a more reliable firearm.

What is claimed is:

1. An ammunition magazine for a firearm, said magazine comprising:

a tube defining a bore adapted to receive a plurality of cartridges, said bore having an axis extending lengthwise along said tube through a geometric center of said bore;

a base positioned at a first end of said tube, said base oriented transversely to said axis and underlying said bore;

a follower positioned within said bore and movable through said tube lengthwise along said axis;

a spring positioned within said bore between said base and said follower for biasing said follower toward a second end of said tube opposite to said first end;

a first lip positioned on a first side of said tube at said second end of said tube;

a second lip positioned at said second end of said tube on a second side thereof opposite to said first lip, said second lip being closer to said axis than said first lip, said first and second lips thereby defining an opening in said tube offset from said axis toward said first side of said tube, wherein said tube comprises:

first and second sidewalls positioned respectively on first and second sides of said bore;

a projection extending from one of said first and second sidewalls toward said bore, said projection being positioned in spaced relation to said opening and engageable with said cartridges for skewing said cartridges relatively to said axis, said projection comprising an elongated surface oriented parallel to said axis, said elongated surface comprising a first ramp sloped toward said base and a second ramp sloped toward said opening.

2. The magazine according to claim 1, wherein said bore has a rectangular cross sectional shape.

3. The magazine according to claim 1, wherein said second lip comprises an edge of a sidewall forming said tube.

4. The magazine according to claim 3, wherein a portion of said sidewall comprising said edge is angularly oriented toward said axis.

5. The magazine according to claim 1, wherein said first and second lips are oriented angularly about said axis relatively to said bore, said opening defined by said lips being thereby skewed about said axis.

6. The magazine according to claim 5, wherein said opening is skewed at an angle to said axis ranging from 1° to 5°.

7. The magazine according to claim 5, wherein said opening is skewed at an angle of 3° to said axis.

8. The magazine according to claim 1, wherein said projection extends from said first sidewall.

9. The magazine according to claim 1, wherein said projection is positioned to engage said cartridges adjacent to or within a rebate thereof.

10. The magazine according to claim 1, wherein said projection is positioned to engage said cartridges adjacent to a projectile thereof.

11. The magazine according to claim 1, wherein said tube comprises first and second sidewalls positioned respectively on first and second sides of said bore, said first and second sidewalls being in spaced apart relation sufficient to receive said cartridges in a single stack.

12. The magazine according to claim 1, wherein said tube comprises first and second sidewalls positioned respectively on first and second sides of said bore, said first and second sidewalls being in spaced apart relation sufficient to receive said cartridges in a semi-staggered stack.

13. An ammunition magazine for a firearm, said magazine comprising:

a tube defining a bore adapted to receive a plurality of cartridges, said bore having an axis extending lengthwise along said tube through a geometric center of said bore;

a base positioned at a first end of said tube, said base oriented transversely to said axis and underlying said bore;

a follower positioned within said bore and movable through said tube lengthwise along said axis;

a spring positioned within said bore between said base and said follower for biasing said follower toward a second end of said tube opposite to said first end;

a first lip positioned on a first side of said tube at said second end of said tube;

a second lip positioned at said second end of said tube on a second side thereof opposite to said first lip, said second lip being closer to said axis than said first lip, said first and second lips thereby defining an opening in said tube offset from said axis toward said first side of said tube, said first and second lips being oriented angularly about said axis relatively to said bore, said opening defined by said lips being thereby skewed about said axis.

14. The magazine according to claim 13, wherein said opening is skewed at an angle to said axis ranging from 1° to 5°.

15. The magazine according to claim 13, wherein said opening is skewed at an angle of 3° to said axis.

16. The magazine according to claim 13, wherein said tube comprises first and second sidewalls positioned respectively on first and second sides of said bore, said first and second sidewalls being in spaced apart relation sufficient to receive said cartridges in a single stack.

17. The magazine according to claim 13, wherein said tube comprises first and second sidewalls positioned respectively on first and second sides of said bore, said first and second sidewalls being in spaced apart relation sufficient to receive said cartridges in a semi-staggered stack.

* * * * *